US006337449B1

(12) United States Patent
Brouillat et al.

(10) Patent No.: US 6,337,449 B1
(45) Date of Patent: Jan. 8, 2002

(54) LIMITING CIRCUIT BREAKER COMPRISING AN AUXILIARY ENERGY STORAGE MEANS

(75) Inventors: Alain Brouillat, La Valette; Jean-Philippe Herpin, Les Marches, both of (FR)

(73) Assignee: Square d Company, Palatine, IL (US)

( * ) Notice: Subject to any disclaimer, the term of this patent is extended or adjusted under 35 U.S.C. 154(b) by 0 days.

(21) Appl. No.: 09/516,186

(22) Filed: Mar. 1, 2000

(30) Foreign Application Priority Data

Apr. 22, 1999 (FR) ..... 99 05276

(51) Int. Cl.[7] ..... H01H 77/10
(52) U.S. Cl. ..... 200/400; 218/153; 335/185
(58) Field of Search ..... 200/286–288, 200/400; 335/16, 46, 147, 185, 190, 192–195; 218/152, 153

(56) References Cited

U.S. PATENT DOCUMENTS 3,469,216 A * 9/1969 Shiraishi ..... 335/195
4,144,513 A * 3/1979 Shaffer et al. ..... 335/16 X
4,713,508 A 12/1987 Baginski et al. ..... 200/568
4,841,286 A 6/1989 Wulff ..... 335/16
4,849,726 A 7/1989 Miura et al. ..... 335/195
5,363,076 A 11/1994 Miller et al. ..... 335/16

FOREIGN PATENT DOCUMENTS

| | | |
|---|---|---|
| EP | 0 189 887 | 8/1986 |
| FR | 2 589 626 | 5/1987 |
| GB | 1 564 412 | 4/1980 |

* cited by examiner

*Primary Examiner*—J. R. Scott
(74) *Attorney, Agent, or Firm*—Parkhurst & Wendel, L.L.P.

(57) ABSTRACT

A low-voltage limiting circuit breaker comprises a stationary contact part and a movable contact part itself comprising a support pivoting around a fixed axis between a closed position and an open position, a contact finger pivoting around a fixed axis between a non-repelled position and a repelled position, and a bistable device comprising a spring arranged between the support and the finger. When the finger is positioned in its repelled position and the support pivots from its closed position to its open position, it drives the finger to its non-repelled position. A part of the energy necessary to pass the dead point of the bistable device is provided by a spring which urges the support to its open position only at the beginning of opening, which enables the opening spring of the circuit breaker not to be overdimensioned.

7 Claims, 6 Drawing Sheets

LIMITING CIRCUIT BREAKER COMPRISING AN AUXILIARY ENERGY STORAGE MEANS

BACKGROUND OF THE INVENTION

The invention relates to a low-voltage limiting circuit breaker, and more particularly to a low-voltage limiting circuit breaker of high rating.

The document GB-A-1,564,412 describes a low-voltage limiting circuit breaker of high rating comprising

- a case;
- an opening mechanism comprising at least one energy storage means;
- one or more poles each comprising:
  - a stationary contact part fixed with respect to the case;
  - a stop fixed with respect to the case;
  - a movable contact part comprising:
    - a support movable relatively to the case between a closed position and an open position;
    - at least one movable contact finger movable relatively to the support between a non-repelled position and a repelled position;
    - at least one bistable mechanism comprising a spring arranged between the support and the finger in such a way that it passes via a maximum potential energy when the finger and support are situated in a dead point position relatively to one another, that it tends to urge the finger to its repelled position when the finger is situated relatively to the support between its repelled position and the dead point position, and that it tends to urge the finger to its non-repelled posit ion when the finger is situated relatively to the support between its non-repelled position and the dead point position;
  - the stop being arranged in such a way that when the finger is positioned in its repelled position and the support moves from its closed position to its open position, the finger, once in contact with the stop, remains in contact therewith until the support passes beyond an intermediate rocking position relatively to the case, corresponding to the relative dead point position with respect to the finger,
- the opening mechanism being kinematically linked to the support in such a way as to urge the support to its open position when the support is in its closed position.

The spring of the bistable device performs several functions. It is first of all designed to provide a contact pressure between the stationary contact part and the contact finger when the circuit breaker is closed which pressure is relatively independent from the state of wear and the manufacturing tolerances of the circuit breaker. This contact pressure is moreover determinant for the repulsion threshold beyond which the electromagnetic forces will drive the finger to its repelled position. When the finger has pivoted beyond the dead point, the spring also serves the purpose of confirming repulsion and/or of preventing the finger from rebounding, since it prevents the finger from returning to a non-repelled position. Before the circuit breaker can be closed again, the energy storage means of the opening mechanism has to be released, which drives the bar and, with said bar, the support of the movable contact part to the open position, and which enables the finger to pivot to the non-repelled position by cooperation with the stop.

In such a device, the energy storage means of the opening mechanism has to overcome the resistance of the spring of the bistable device. However this passage should preferably take place at the beginning of opening travel in order to limit the dimensions of the circuit breaker compartment where the contacts are located. The support for its part has to pivot at sufficiently high speed, when passing the intermediate rocking position, for the return force of the spring of the bistable device not to give rise to too great a movement of the finger and the stationary contact towards one another after the dead point has been passed.

Consequently, the spring of the opening mechanism has to simultaneously speed up the support and compress the spring of the bistable device. In energy terms, it has to simultaneously supply the spring of the bistable device with the energy necessary for the latter to reach its maximum potential energy state, and supply the support with the kinetic energy necessary for high-speed movement thereof to the open position. Let us also recall that the spring of the opening mechanism also has to achieve on its own high-speed opening of the circuit breaker in the event of tripping on a weak current surge.

To reconcile these requirements, a powerful opening energy storage means is generally provided. However this solution is not without drawbacks since the energy released on opening has to be dissipated in the end of opening travel stops so that the power of the spring is determinant for the cost and dimensions of the circuit breaker. Furthermore, different opening mechanisms have to be provided depending on the number of poles of the circuit breaker. Let us recall that not only single-pole, three-pole and four-pole circuit breakers are encountered, but also, for high ratings where each phase is connected to two poles in parallel or serially, six-pole or even eight-pole circuit breakers.

The dimensioning problem is even more complicated when identical movable contact parts of the identical fingers and bistable devices, using supports, are designed to equip circuit breakers whose opening mechanisms are of different kinds. It is in fact desirable to be able to equip a range of circuit breakers indifferently with a first type of mechanism in which the energy storage means of the opening mechanism also releases the energy required for closing of the circuit breaker, and with a second type of mechanism, called O-C-O (for open, closed, open) in which a closing energy storage means is loaded independently from the position of the contacts and performs loading of the opening energy storage means simultaneously when closing takes place. However the two types of mechanism have different opening kinematics. We thus generally consider that, for a given opening energy, i.e. for a given opening spring, the O-C-O mechanism operates at lower speed at the beginning of opening travel and at higher speed at the end of opening travel.

SUMMARY OF THE INVENTION

The object of the invention is therefore to overcome the shortcomings of the prior art and in particular to enable movable contact parts with identical bistable mechanisms to be used for limiting circuit breakers whose opening mechanisms have variable characteristics in particular at the beginning of opening travel. Its object is also to enable the opening mechanism of a limiting circuit breaker to be dimensioned regardless of the number of poles. Another object of the invention is to make speeding-up of the support of a movable contact part at the beginning of opening travel relatively independent from the type of opening mechanism implemented. Another object of the invention is to limit the energy to be dissipated at the end of opening travel, without notably increasing either the opening travel or the dimensions of the apparatus. Another object is to reduce the energy required on opening to a minimum.

According to the invention, these objects are achieved by means of a circuit breaker of the above-mentioned type, wherein each pole further comprises an auxiliary mechanism comprising one or more energy storage means urging the support to its open position over all or part of the travel of the support between its closed position and the intermediate rocking position, but no longer urging the support to its open position beyond the intermediate rocking position. The speeding-up at the beginning of opening travel can thus be adjusted by choosing the power of the second energy storage means judiciously.

Preferably the energy storage means of the auxiliary mechanism do not act on the support when the latter is located between its intermediate rocking position and its open position. Beyond the rocking position, the support does not require much energy to reach its open position, so that the energy provided by the second energy storage means is no longer necessary.

Alternatively, an energy storage means can be provided supplying energy to the support over a part of its travel at least between the closed position and the intermediate rocking position and storing energy over at least a part of the travel of the support between the intermediate position and the open position. This energy storage means may for example comprise a spring whose rest position corresponds to the relative rocking position, acting in compression before this position and in traction beyond it. This enables the energy remaining to be dissipated in the end-of-travel stops of the opening mechanism at the end of opening travel to be limited even further.

Preferably, the energy storage means of the auxiliary mechanism of each pole are such that when movement of the movable support of the pole involved takes place, they release an energy greater than or equal to that necessary to move the bistable mechanism(s) of the pole involved to their maximum potential energy. This arrangement is particularly advantageous for a multipole circuit breaker comprising an operating mechanism common to all the poles. It is then in fact easier to dimension the opening spring independently from the number of poles, while limiting the power of said spring.

According to one embodiment, the circuit breaker comprises in addition latching means. This arrangement fosters movement from the intermediate rocking position to the open position. It therefore enables the kinetic energy required for movement from the intermediate rocking position to be limited. This consequently enables the power of the auxiliary mechanism to be limited and furthermore limits the energy to be dissipated in the end of opening travel stops.

According to a preferred embodiment, the energy storage means of the auxiliary mechanism each comprise a spring arranged between the case and the support. Alternatively, it would naturally be possible to make the auxiliary energy storage means act indirectly on the support, for example on an intermediate part of the kinetic transmission system linking the energy storage means of the opening mechanism to the support. However, the preferred embodiment provides the advantage of limiting the stresses on this kinematic transmission system. Advantageously the case comprises polar compartments each containing one of said poles, the spring of each energy storage means of the auxiliary mechanism of each pole being located in the corresponding polar compartment.

According to one embodiment, the spring is a compression spring arranged inside a cylinder closed by a piston head designed to come into contact with the support and to transmit the force of the compression spring thereto. Alternatively, other types of springs can be envisaged, for example torsion or flexion springs.

BRIEF DESCRIPTION OF THE DRAWINGS

Other advantages. and features of the invention will become more clearly apparent from the following description of an embodiment of the invention, given as a non-restrictive example only and represented in the accompanying drawings in which.

DETAILED DESCRIPTION OF THE PREFERRED EMBODIMENT

Figure 1:
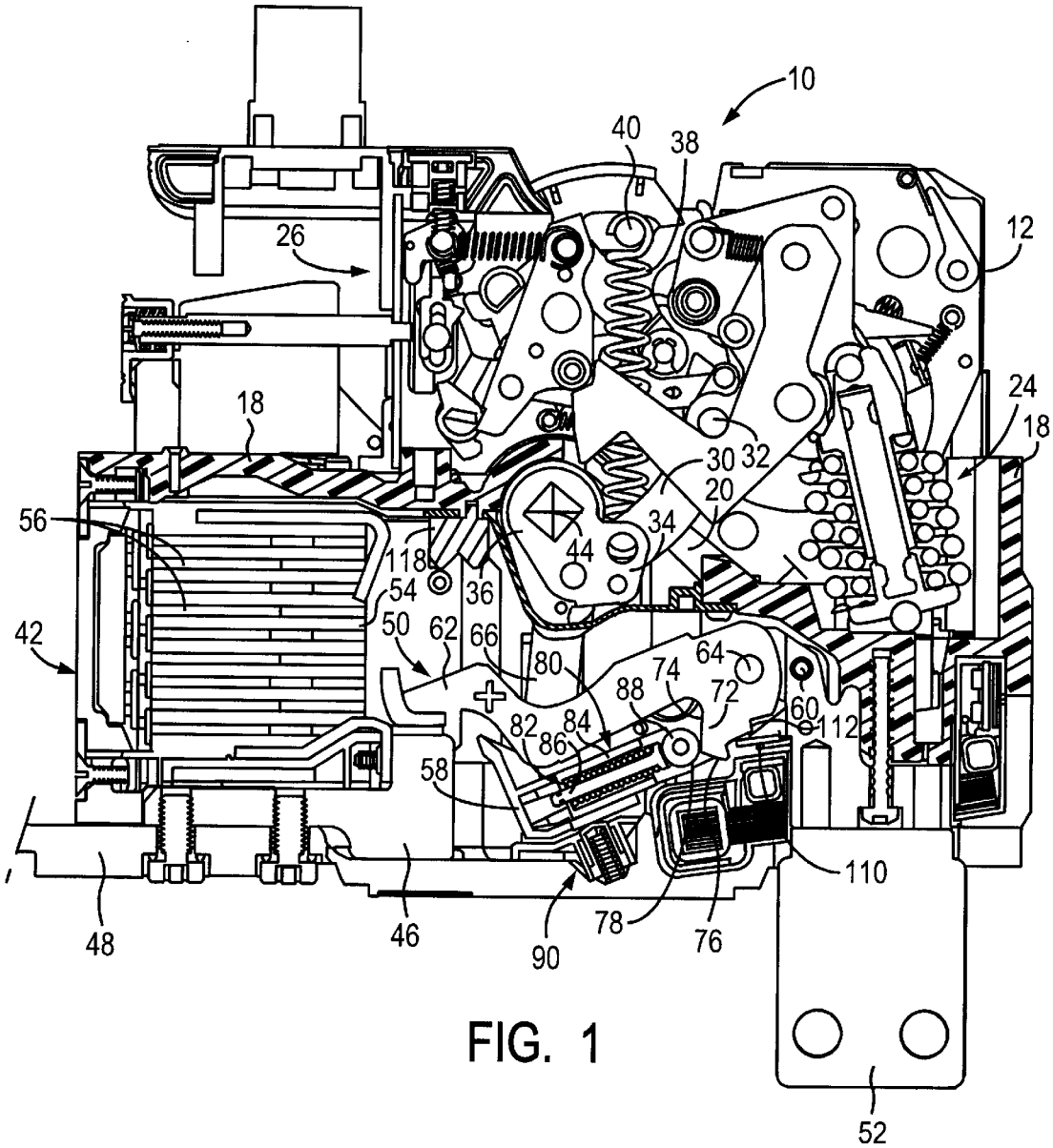
FIG. 1 represents a cross-sectional view of a circuit breaker according to the invention, in the closed non-repelled position.
Figure 2:
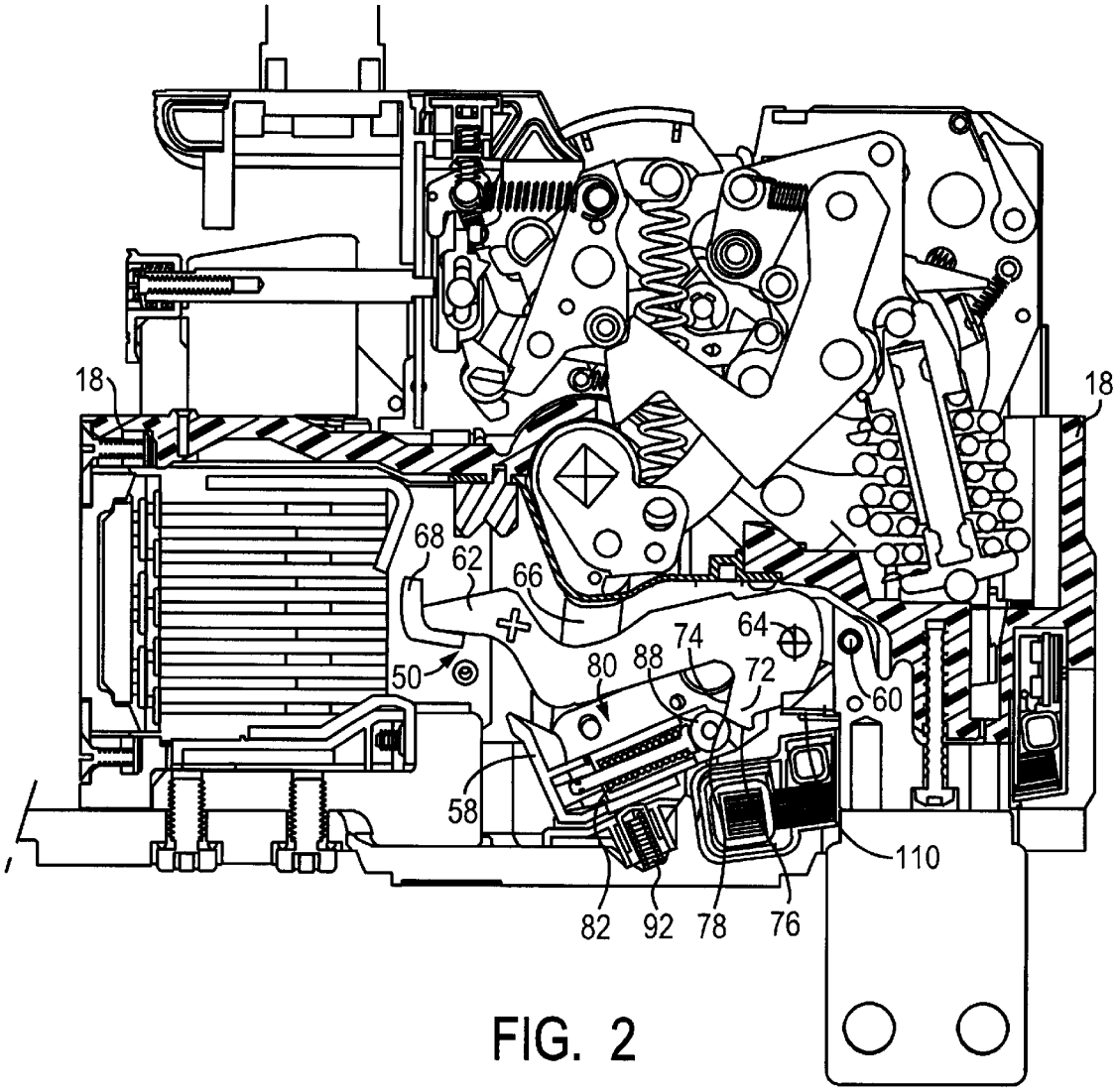
FIG. 2 represents in cross-section the circuit breaker of FIG. 1, in the closed, partially repelled position, when a dead point is passed.

With reference to FIGS. 1 to 5, a multipole low-voltage limiting circuit breaker of high rating 10 comprises a case 12 divided into a front compartment 14 and a rear compartment 16 by an intermediate partitioning wall 18. A window 20 made in the intermediate partitioning wall enables communication between the front and rear compartments.

The front compartment 14 acts as housing for an operating device 22 which comprises an energy storage closing mechanism 24 and an opening mechanism 26. This device is known as such and reference should be made to the document FR-A-2,589,626 for further details thereon. It will merely be recalled here that the opening mechanism 26 comprises a toggle device comprising two rods 28, 30 articulated on one another by a pivoting spindle 32, the bottom transmission rod 30 being coupled to a crank 34 of a switching bar 36. An opening spring 38 is secured between the crank 34 and a fixed securing pin 40.

The rear compartment 16 acts as housing for the switching bar 36 and for a plurality of poles 42 arranged side by side along a pivoting axis 44 of the switching bar 36 in individual compartments separated by tight partitions appreciably parallel to the plane of FIGS. 1 to 5. Each pole 42 comprises a stationary contact part 46 connected to a connection strip 48, a movable contact part 50 connected to a connection strip 52 and an arc extinguishing chamber 54 equipped with metallic separators 56. The movable contact part 50 comprises a movable support 58 mounted pivoting around a fixed geometric axis 60 with respect to the case, and a contact finger 62 pivoting around a geometric axis 64 fixed with respect to the case and eccentric with respect to the axis 60. A connecting rod 66 couples the support 58 to the switching bar 36. One end of the finger 62 supports a contact pad 68 designed to perform contact with a contact pad 70 supported by the stationary contact part 46. The other end of the finger 62 forms a cam 72 with two ramps 74, 76 on each side of a top dead point 78. Between the support 58 and the finger 62 there is arranged a flexible energy storage means comprising a spring 82 guided in a cage 84 and repelling therefrom a rod 86 supporting a rotating roller 88. The roller 88 is thus permanently in contact with the cam 72. The flexible energy storage means forms a bistable mechanism 80 with the cam 72.

Figure 5:
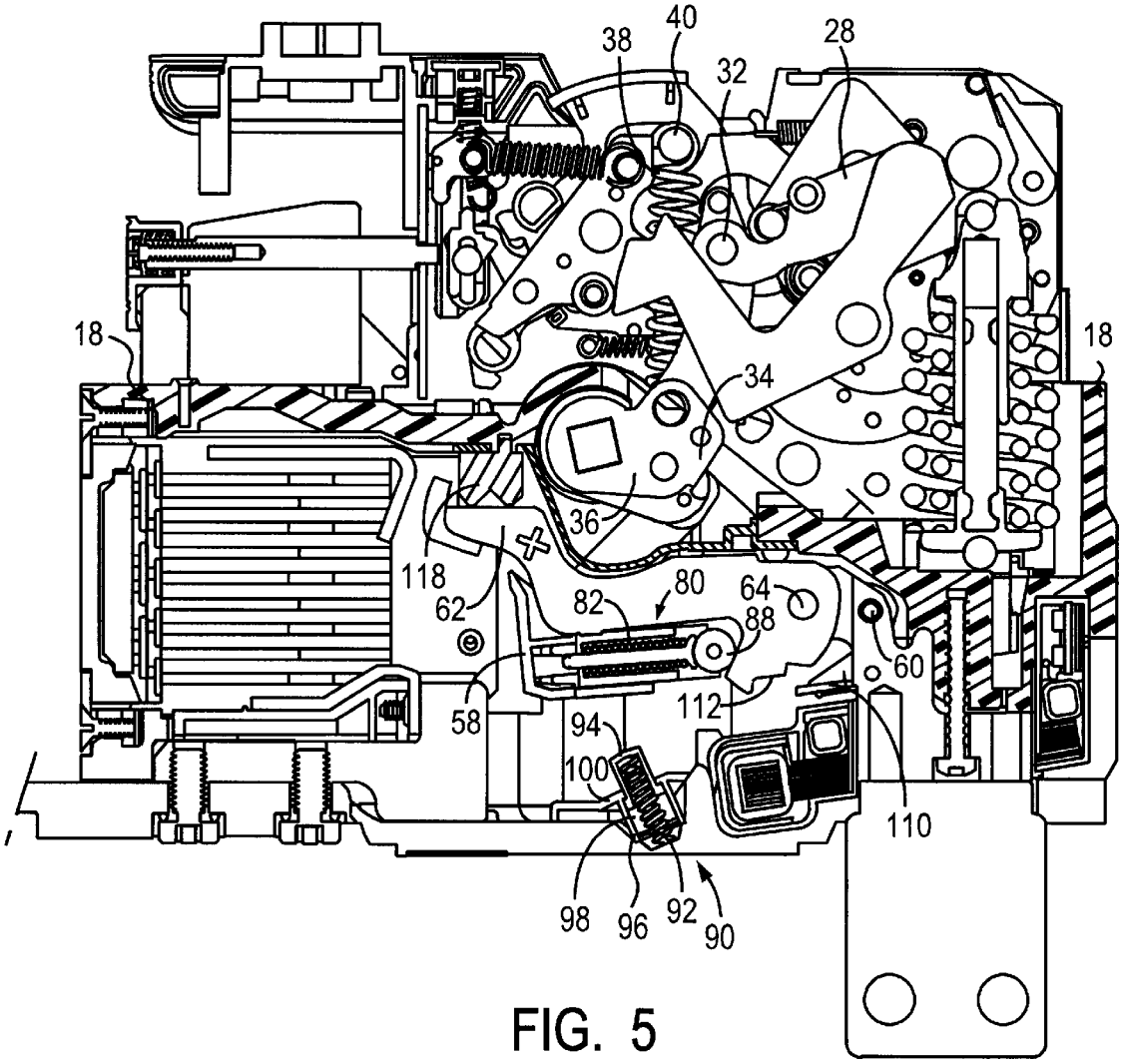
FIG. 5 represents in cross-section the circuit breaker of FIG. 1, in the open position.

Between the case 12 and support 58 there is arranged an auxiliary flexible energy storage means 90, able to be seen in its relaxed state in FIG. 5, and comprising a compression spring 92 tending to repel in the direction of the support 58 a head 94 guided in translation in a cylinder 96 fixed with respect to the case 12. The front part of the head 94 comprises a pad 98 designed to cooperate radially with the cylinder to perform guiding and axially with a flange 100 partially closing the cylinder and forming an end-of-travel stop.

Figure 6:
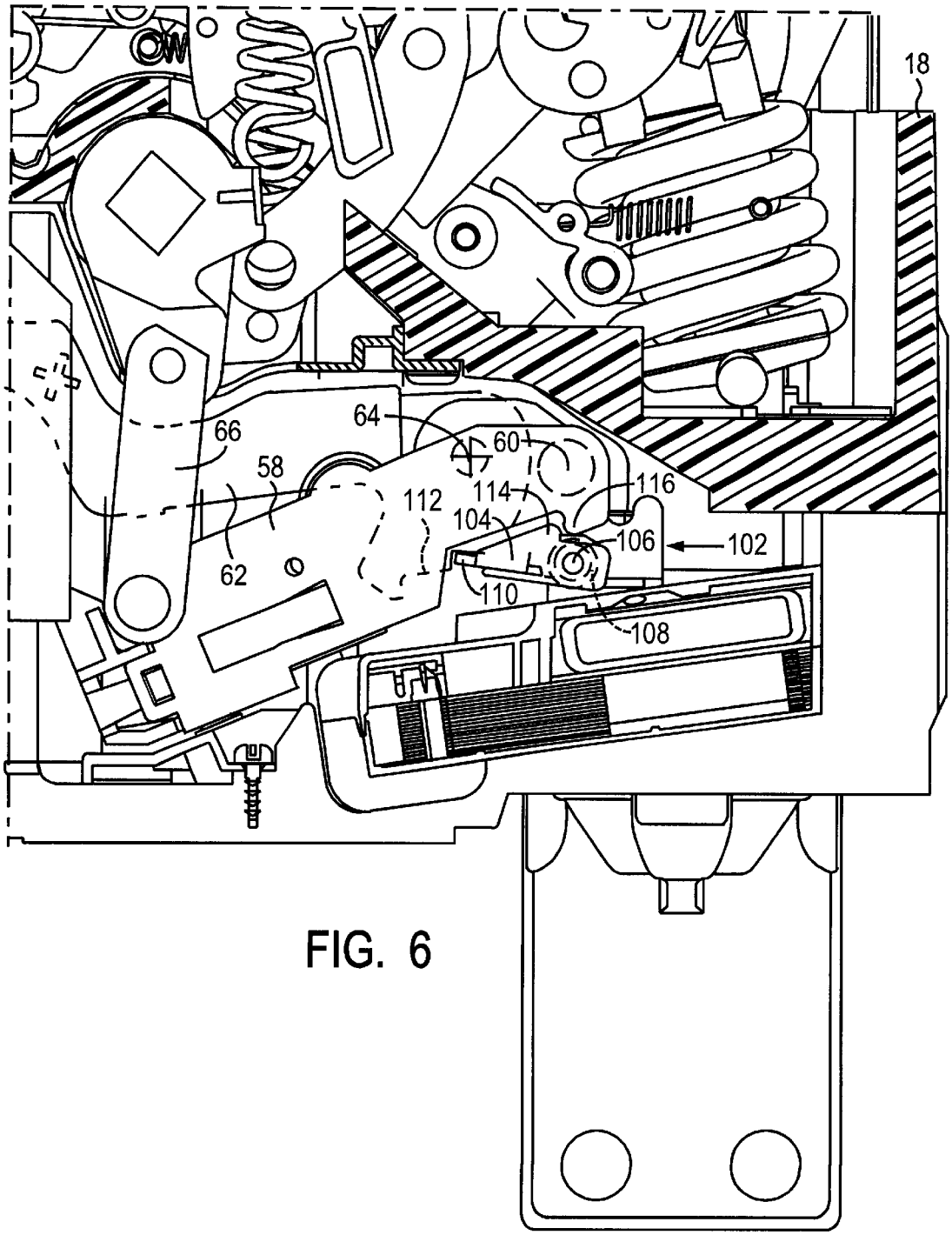
FIG. 6 represents in a cross-sectional plane parallel to that of FIG. 1, a latching mechanism in a position corresponding to the closed repelled position of FIG. 3.

A latching device 102, able to be seen in detail in FIG. 6, comprises an arm 104 pivoting around a fixed spindle 106 and flexibly urged in the clockwise direction in the figure by a torsion spring 108. A movable stop 110 is situated at the end of the arm 104 and cooperates with a stepped surface 112 of the finger 62. The arm has in addition a spigot 114 designed to cooperate with a cam 116 situated on the support 58.

The intermediate wall 18 supports an end-of-travel stop 118 made of elastomer material.

Operation of the device is as follows:

In the closed position of FIG. 1, the contact pads 68, 70 are in contact with one another and perform closing of the electrical circuit between the connection strips 48, 52. The spring 82 of the bistable mechanism 80 is compressed and the roller 88 cooperates with the ramp 74 so as to provide a contact pressure between the pads 68, 70. In the presence of a current surge, the electromagnetic forces tend to make the finger 62 pivot around its axis in the clockwise direction in the figures, and the bistable mechanism 80 tends to oppose this pivoting. When the current intensity exceeds a limiting threshold corresponding to the calibration of the spring 82, the finger 62 pivots and passes the dead point 78 of the bistable mechanism 80, represented in FIG. 2. Once this dead point has been passed, the roller 88 cooperates with the ramp 76 and contributes to repelling the finger 62 towards the end-of-travel stop 118, to the position of FIG. 3. The stop 118 acts as a damper and, by absorbing the excess kinetic energy, prevents the finger 62 from rebounding. The stop 110 of the latching device 102 pivots urged by its return spring 108 and remains in contact with the stepped surface 112 of the finger 62, so that the latching mechanism 102 prevents the finger 62 from returning to the down position.

To be able to reclose the circuit breaker, an opening operation has to be performed previously by the operating mechanism. An opening latch, actuated by an operator or a trip device, releases the connecting rod system 28, 30, 32. The opening spring 38, assisted by the springs 92 of the auxiliary energy storage means 90 of each pole, moves the switching bar 36 in counterclockwise rotation and, by means of the connecting rod 66, makes the support 58 pivot clockwise around its axis 60 from the position of FIG. 3 to the position of FIG. 4 then continues on its own to urge the bar 36 until the position of FIG. 5 is reached.

Figure 3:
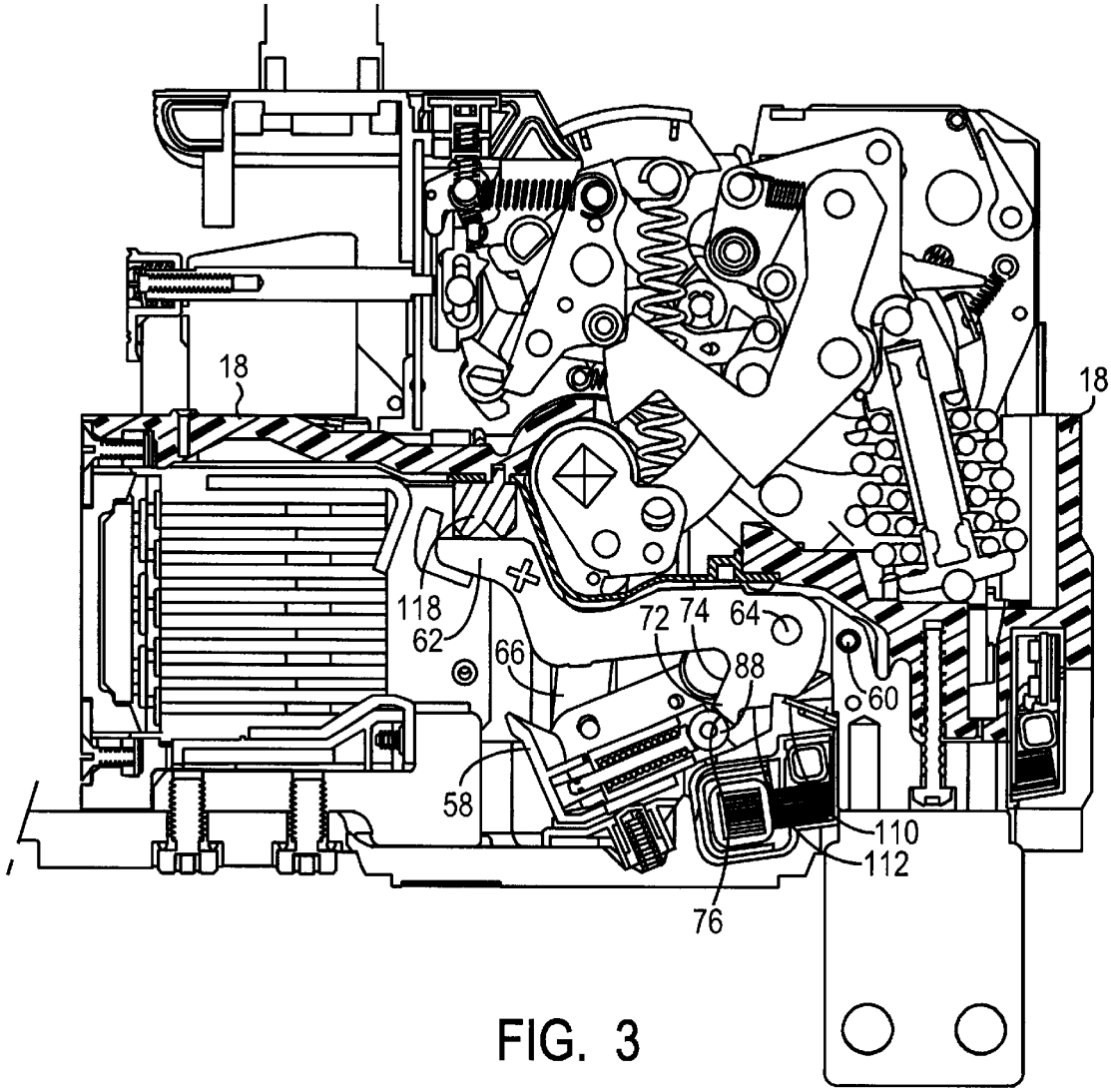
FIG. 3 represents in cross-section the circuit breaker of FIG. 1, in the closed, repelled position.
Figure 4:
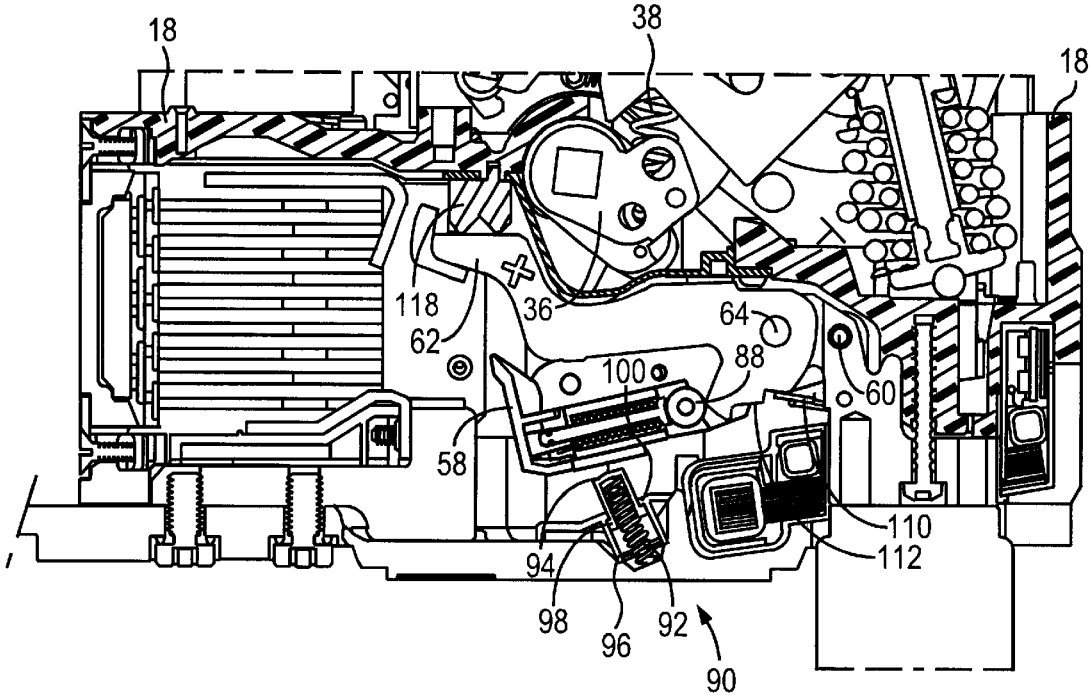
FIG. 4 represents in cross-section the circuit breaker of FIG. 1, in an intermediate rocking position.

Between the position of FIG. 3 and that of FIG. 4, the roller 88 cooperates with the ramp 76 and applies on the finger 62 a force whose moment tends to make the finger 62 rotate clockwise around the axis 64. The damper. 118 then acts as an end-of-travel stop so that the finger 62 remains immobile; it is therefore the roller 88 that is retracted by compressing the spring 82. In this phase, the auxiliary energy storage means 80 of each pole repels the corresponding support 58. The head 94 of the auxiliary energy storage means 80 reaches its end-of-travel position when the support 58 reaches the intermediate rocking position of FIG. 4, so that contact between the head of the auxiliary energy storage means and the support ceases.

Beyond this intermediate rocking position, the roller 88 solicits the ramp 74. The counterclockwise movement of the finger 62 is however counteracted by the stop 110 of the latching means 102, so that the finger 62 remains relatively immobile, with exception made for its assembly clearance. The action of the opening spring 38 and that of the spring 82 of the bistable mechanism are combined and move the support 58 clockwise to its up position of FIG. 5. In an intermediate position between the position of FIG. 4 and that of FIG. 5, very close to the latter position, the cam 116 of the support 58 repels the spigot 114 of the arm 104 so that the latter pivots counterclockwise and releases the stop 110. However, this releasing does not lead to any notable counterclockwise pivoting of the finger 62, as the movement of the support 58 is then practically completed.

From the position of FIG. 6, closing can be triggered by action on a closing latch which releases a closing spring, making the switching bar pivot from its position of FIG. 6 to its closed position of FIG. 1. The bar 36 drives the support 58 counterclockwise and the finger 62, urged only by the roller 88 which follows the movement of the support 58, is also driven. The support 58 compresses and reloads the spring 92 of the auxiliary energy storage means 90 at the end of closing travel. This accessorily enables the impact at the end of closing travel to be limited.

For simplification purposes, the invention has been described considering each pole to comprise a single contact finger 62, a single bistable mechanism 80 and a single auxiliary energy storage means 90. In practice, it may be advantageous to provide a plurality of fingers per pole, for example three or five identical fingers pivoting around a common axis 64. Each finger must then be biased by a bistable mechanism, which may be common to several fingers or independent for each finger, so that each finger is biased by a different spring. A single support 58 is however still provided for each pole. According to the size of the support 58, in particular its width in a direction perpendicular to the plane of the figures, it may be advantageous to provide an auxiliary energy storage means 90 comprising several springs arranged in parallel. In practice, three springs arranged in parallel and each acting on a different head enable interesting dimensional characteristics to be obtained.

In practice, it is advantageous to dimension the auxiliary energy storage means in such a way that when relaxation thereof takes place they together release a greater energy than that required to compress the spring of the bistable mechanism.

The invention is naturally not limited to the embodiment described above. Various modifications are possible within the scope of the invention.

In the foregoing example, the latching mechanism 102 performs two functions: it acts on the one hand as a debounce device in the sense that, in the event of a short-circuit of very high intensity generating large electrodynamic forces, it prevents the finger, which has reached the position of FIG. 3 and comes and strikes the damper 118 violently, from rebounding and closing the contact; moreover it prevents pivoting of the finger 62 on opening when the support 58 has just passed the intermediate rocking position. However, depending on the circuit breaker rating and the dimensioning of the mechanical parts, it can be envisaged to eliminate this latching mechanism. The debounce function is then performed exclusively by the bistable mechanism 80, which may be assisted by the end-of-travel damper 118. The movement beyond the intermediate rocking position can for its part be limited in amplitude so as to become imperceptible, if the speed of the support 58 when passing the rocking position is sufficient.

In the described embodiment, the stop 118 performs two functions: it acts firstly as a debounce device since it absorbs a part of the kinetic energy at the end of travel of the finger 62 to its repelled position; it moreover enables the finger 62 to be immobilized when the support 58 pivots from its closed position to its intermediate rocking position. According to an alternative embodiment, these two functions can be performed by different parts. An end of repulsion travel stop of the finger can for example be arranged on the support 58 and an independent stop be arranged on the case. This arrangement enables the support 58 and the repelled finger 62 to be raised together in a first part of the travel of the support 58 to its open position before the finger 62 encounters the case stop and is immobilized with respect to the latter.

The invention has been described with reference to a limiting circuit breaker whose fingers pivot around a geometric axis 64 fixed with respect to the case. It is however also applicable to a limiting circuit breaker as for example described in the document GB-A-1,564,412 whose fingers pivot around an axis fixed with respect to the support itself pivoting around an axis fixed with respect to the case and offset with respect to the latter.

The switching bar 36 and support 58 may form a single part, in which case the connecting rod 66 disappears and the operating mechanism connecting rod system 28, 30, 32 is directly articulated via one of its ends on the support. This configuration corresponds to the mechanism of the document GB-A-1,564,412.

The invention is also applicable regardless of the type of opening and closing mechanism of the circuit breaker.

What is claimed is:

1. A low-voltage limiting circuit breaker comprising a case;

an opening mechanism comprising at least one energy storage means;

one or more poles each comprising:

a stationary contact part fixed with respect to the case;

a movable contact part comprising:

a support movable relatively to the case between a closed position and an open position;

at least one movable contact finger movable between a non-repelled position and a repelled position relatively to the support;

at least one bistable mechanism comprising a spring arranged between the support and the finger so that it passes via a maximum potential energy when the finger and support are situated in a dead point position relatively to one another, that it tends to urge the finger to its repelled position when the finger is situated relatively to the support between its repelled position and the dead point position, and that it tends to urge the finger to its non-repelled position when the finger is situated relatively to the support between its non-repelled position and the dead point position;

a stop fixed with respect to the case for entering and remaining in contact with the finger when the finger is positioned in its repelled position and the support moves from its closed position to its open position, and remains in contact with the finger until the support passes beyond an intermediate rocking position relatively to the case, corresponding to the relative dead point position with respect to the finger, a kinematic transmission link between the opening mechanism and the support configured to urge the support to its open position when the support is in its closed position; and an auxiliary mechanism comprising one or more energy storage means urging the support to its open position over all or part of the travel of the support between its closed position and the intermediate rocking position, but no longer urging the support to its open position beyond the intermediate rocking position.

2. The circuit breaker according to claim 1, wherein the energy storage means of the auxiliary mechanism do not act on the support when the support is located between its intermediate rocking position and its open position.

3. The circuit breaker according to claim 1, wherein the energy storage means of the auxiliary mechanism of each pole are such that when movement of the support of the pole involved takes place, the energy storage means release an energy greater than or equal to that necessary to move the bistable mechanism(s) of the pole involved to their maximum potential energy.

4. The circuit breaker according to claim 1, wherein each pole further comprises means between the finger and the case for latching the finger in the repelled position.

5. The circuit breaker according to claim 1, wherein the energy storage means of the auxiliary mechanism each comprise a spring arranged between the case and the support.

6. The circuit breaker according to claim 5, wherein the case comprises polar compartments each containing one of said poles, the spring of each energy storage means of the auxiliary mechanism of each pole being located in the corresponding polar compartment.

7. The circuit breaker according to claim 6, wherein the spring of each energy storage means of the auxiliary mechanism is a compression spring arranged inside a cylinder closed by a piston head designed to come into contact with the support and to transmit the force of the compression spring thereto.

* * * * *